US007581340B2

(12) United States Patent
Wolfe

(10) Patent No.: US 7,581,340 B2
(45) Date of Patent: Sep. 1, 2009

(54) SCRAPER BLADE ATTACHMENT FOR TOOTHED BUCKETS OF EARTH WORKING MACHINES

(76) Inventor: Brian John Wolfe, 4306 5th Avenue S.E., Calgary, Alberta (CA) T2A 3B6

( * ) Notice: Subject to any disclaimer, the term of this patent is extended or adjusted under 35 U.S.C. 154(b) by 0 days.

(21) Appl. No.: 11/868,778

(22) Filed: Oct. 8, 2007

(65) Prior Publication Data

US 2009/0090034 A1 Apr. 9, 2009

(51) Int. Cl.
*E02F 3/76* (2006.01)

(52) U.S. Cl. ..... 37/407; 37/455; 37/468; 37/903

(58) Field of Classification Search ..... 37/404, 37/468, 407, 450, 455, 903
See application file for complete search history.

(56) References Cited

U.S. PATENT DOCUMENTS

| | | | | | |
|---|---|---|---|---|---|
| 1,023,849 | A | * | 4/1912 | Huish | 294/51 |
| 1,429,125 | A | * | 9/1922 | Burns | 172/794 |
| 1,850,341 | A | * | 3/1932 | Dean | 172/794 |
| 2,736,279 | A | * | 2/1956 | Johnston | 111/125 |
| 3,469,330 | A | * | 9/1969 | Hood et al. | 37/404 |
| 3,523,380 | A | | 8/1970 | Bolyard et al. | |
| 3,765,109 | A | | 10/1973 | Daviduke | |
| 3,942,271 | A | | 3/1976 | George | |
| 3,995,384 | A | * | 12/1976 | Wood | 37/446 |
| 4,009,529 | A | | 3/1977 | Johnson | |
| 4,208,815 | A | * | 6/1980 | Yunker et al. | 37/446 |
| 4,458,379 | A | * | 7/1984 | Shelton | 16/297 |
| 4,819,349 | A | * | 4/1989 | Mensch | 37/407 |
| 4,895,042 | A | * | 1/1990 | Wang | 74/519 |
| 5,253,449 | A | * | 10/1993 | Webb et al. | 37/446 |
| 5,524,505 | A | * | 6/1996 | Lawrence | 74/544 |
| 5,596,825 | A | | 1/1997 | Schalscha | |
| 5,775,013 | A | | 7/1998 | Von Schalscha | |
| 5,918,389 | A | | 7/1999 | Hall | |
| 6,070,345 | A | * | 6/2000 | Akaki et al. | 37/407 |
| 6,243,975 | B1 | | 6/2001 | Gall | |
| 6,457,268 | B1 | * | 10/2002 | Perry et al. | 37/403 |
| 6,810,610 | B2 | * | 11/2004 | Hardman et al. | 37/407 |
| 6,848,142 | B2 | * | 2/2005 | Truan et al. | 15/78 |
| 6,860,387 | B2 | * | 3/2005 | Chang | 206/214 |

* cited by examiner

*Primary Examiner*—Thomas A Beach
*Assistant Examiner*—Matthew R Buck
(74) *Attorney, Agent, or Firm*—Stephen Lewellyn; Brittany J. Maxey; Maxey Law Offices, PLLC

(57) ABSTRACT

A removable scraper blade attachment for a toothed bucket of an earth working machine, such as a backhoe bucket, to allow the bucket to remove debris from a smooth surface such as a paved surface. A plurality of tooth receiving pockets are space along the upper surface of the mounting plate and are sized to receiving a single tooth. A scraper blade extends across a leading edge of the mounting plate and includes a beveled edge to improve cutting and scraping of the blade. The scraper blade attachment is readily removably attachable to the bucket and does not require modification to the lower lip of the bucket or require removal of teeth from the bucket. A self tensioning system is provided to insure the scraper blade attachment remains tightly secured to the bucket.

11 Claims, 7 Drawing Sheets

SCRAPER BLADE ATTACHMENT FOR TOOTHED BUCKETS OF EARTH WORKING MACHINES

BACKGROUND OF THE INVENTION

1. Field of the Invention

The present invention relates generally to attachments for earth moving machine buckets, and more particularly, relating to a scraper blade attachment for an earth moving machine bucket, which is quickly, easily and securely mounted by a single person without tools over the teeth of such a bucket.

2. Description of the Related Art

Earth moving machines and equipment are frequently fitted with movable buckets to facilitate the movement of earth or other loose material. These buckets are conventionally equipped with teeth spaced along a lower edge or cutting edge of the bucket and project outwardly therefrom. The teeth are used for ripping and loosening soil, rock, pavement and the like. The loosened material is picked up in the bucket by moving the edge of the bucket forward under the material, then generally tilting the buck upward to secure the material in the bucket.

Because the teeth project outwardly from the lower edge of the bucket there are many occasions when the teeth interfere with the desired operation of the bucket. The projecting teeth prevent the lower edge of the bucket from making contact with a smooth surface, such as for example a paved surfaced. Consequently, it becomes difficult, if not impossible to pickup and load fine material such as sand, gravel or various construction debris from a smooth surface.

Heretofore, there have been many attempts to provide grader and scraper attachments for earth moving machine buckets. While the devices heretofore fulfill their respective, particular objectives and requirements, they have many shortcomings. In this regard, many of these devices require modification to the bucket by drilling bolt holes through the lower edge of the bucket, resulting in a weakening of the lower edge. Further, many of these devices require the removal of one or more tooth points from their tooth adapters to provide a mounting point for the attachment. The removal of tooth points is a difficult and time intensive process and can result in damage to either the tooth point, the tooth adapter or the mounting pins. Additionally, many of these devices apply excessive torque to the teeth resulting in premature failure of the teeth. Moreover, many of these devices extend the width of the bucket making the bucket cumbersome and difficult to move.

In view of the shortcomings of the prior devices, a need has continued to exist for improved blade attachments for earth moving machine buckets which permit the bucket to pickup and load fine material such as sand, gravel or various construction debris from a smooth surface.

SUMMARY OF THE INVENTION

In view of the foregoing disadvantages inherent in the known types of bucket attachments now present in the prior art, the present invention provides a new scraper blade attachment construction which overcomes the shortcomings of the prior devices.

In general, in one aspect, a blade attachment adapted to be removably mounted to an earth moving bucket of the type having a pair of spaced sidewalls, a cutting edge extending between the sidewalls, and a plurality of teeth laterally spaced along and projecting forwardly of the cutting edge is provided. The attachment includes a plate having an upper surface, a lower surface, a leading edge, a trailing edge and first and second opposed side edges, a plurality of tooth receiving pockets spaced laterally along the upper surface of the plate and each being configured to receive one or more of the plurality of teeth of the bucket, an elongated scraper blade extending along the leading edge of the plate, and a securment means for releasably securing the attachment on the bucket with one or more of the plurality of teeth removably seated within the plurality of tooth receiving pockets and the scraper blade position forwardly of the cutting edge of the bucket.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
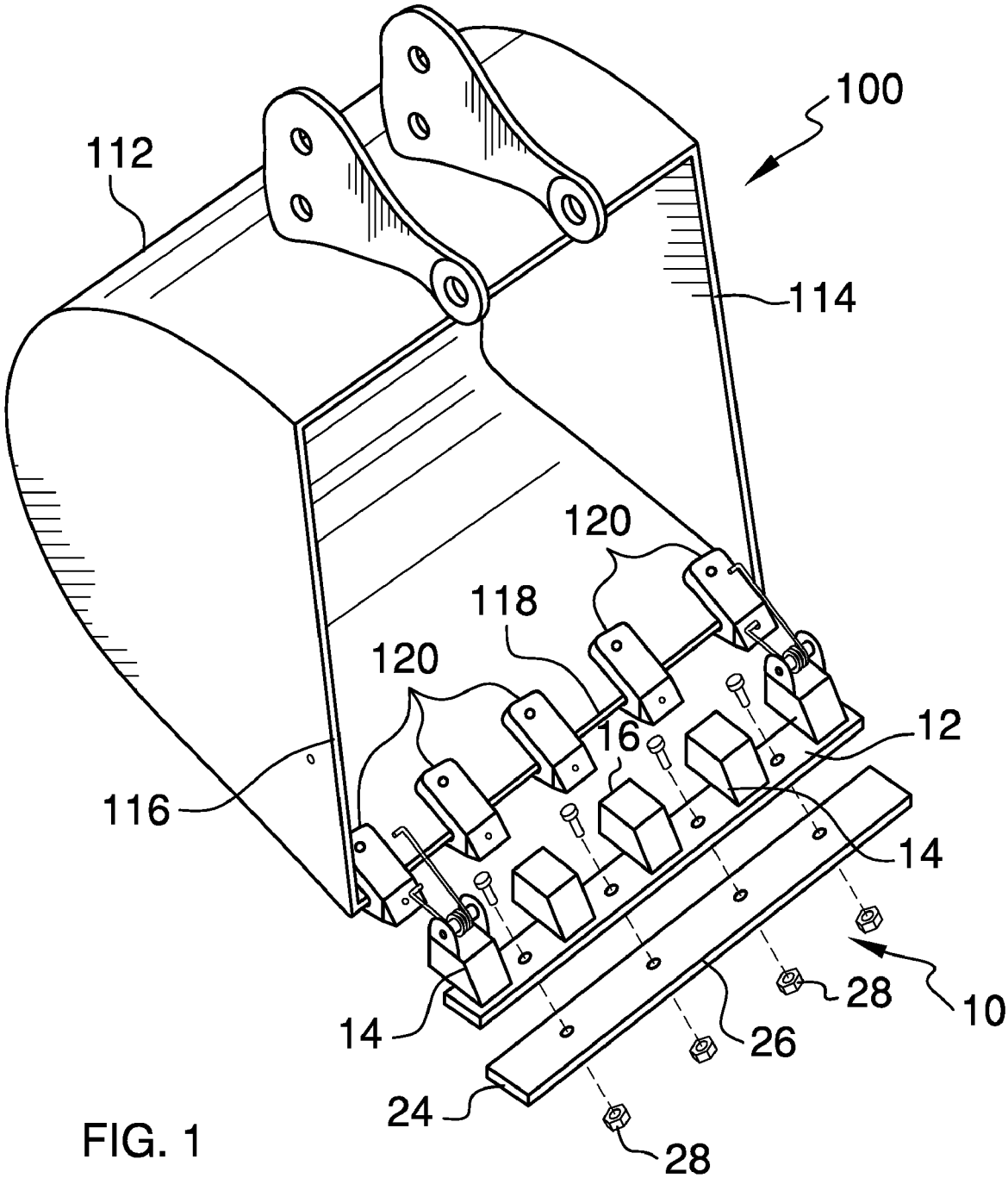
FIG. 1 is a front perspective diagrammatic view of the scraper blade attachment constructed in accordance with the principles of the present invention shown with the various components in an exploded configuration and detached from a conventional toothed bucket.

Referring now to FIG. 1 of the drawings, there is shown a representation of a conventional toothed bucket 100 of an earth moving machine (not shown). The toothed bucket 100 has a rear wall 112, two opposed sidewalls 114 and 116 and a forward cutting edge or lip 118 extending between the opposed sidewalls. A plurality of teeth 120 are spaced along and project outwardly from the lip 18. The scraper blade attachment 10 of the present invention is shown with its components exploded and detached from the bucket 100.

The attachment 10 includes a generally rectangular plate 12 formed of a tough steel sheet material or the like. The plate 12 may be of a length equal to or greater than the width of the bucket 100. A plurality of tooth receivers 14 are spaced laterally along an upper surface 16 of the plate 12, and are attached thereto by an known method, such as, but not limited to by welding. The tooth receivers 14 may be of a generally pocket construction including an open end 16 disposed approximate a trailing edge 18 of the plate 12 and a closed end 20 disposed approximate a leading edge 22 of the plate. The receivers 14 may be constructed to have a longitudinal profile that corresponds to the profile of teeth 120 and sized to snuggly and securely yet releasably receive one or more of the plurality of teeth. Because of the relatively close fit between the receivers 14 and the teeth 120, the attachment 10 is restrained against any significant sideways movement relative to the teeth and the bucket 100. Accordingly, so long as the attachment 10 is held tightly over the teeth 120, it will not shift, wobble or vibrate as it is being used.

A blade 24 extends along the leading edge 22 of the plate 12 and includes a beveled forward edge 26 to improve the cutting and scraping of the blade. The blade 24 can be permanently attached to the plate 12 using conventional means such as welding. Preferably, the blade 24 may be removably attached to the plate 12 by a plurality of bolted connections 28 that alternate between the receivers 14 along the length of the plate.

Figure 2:
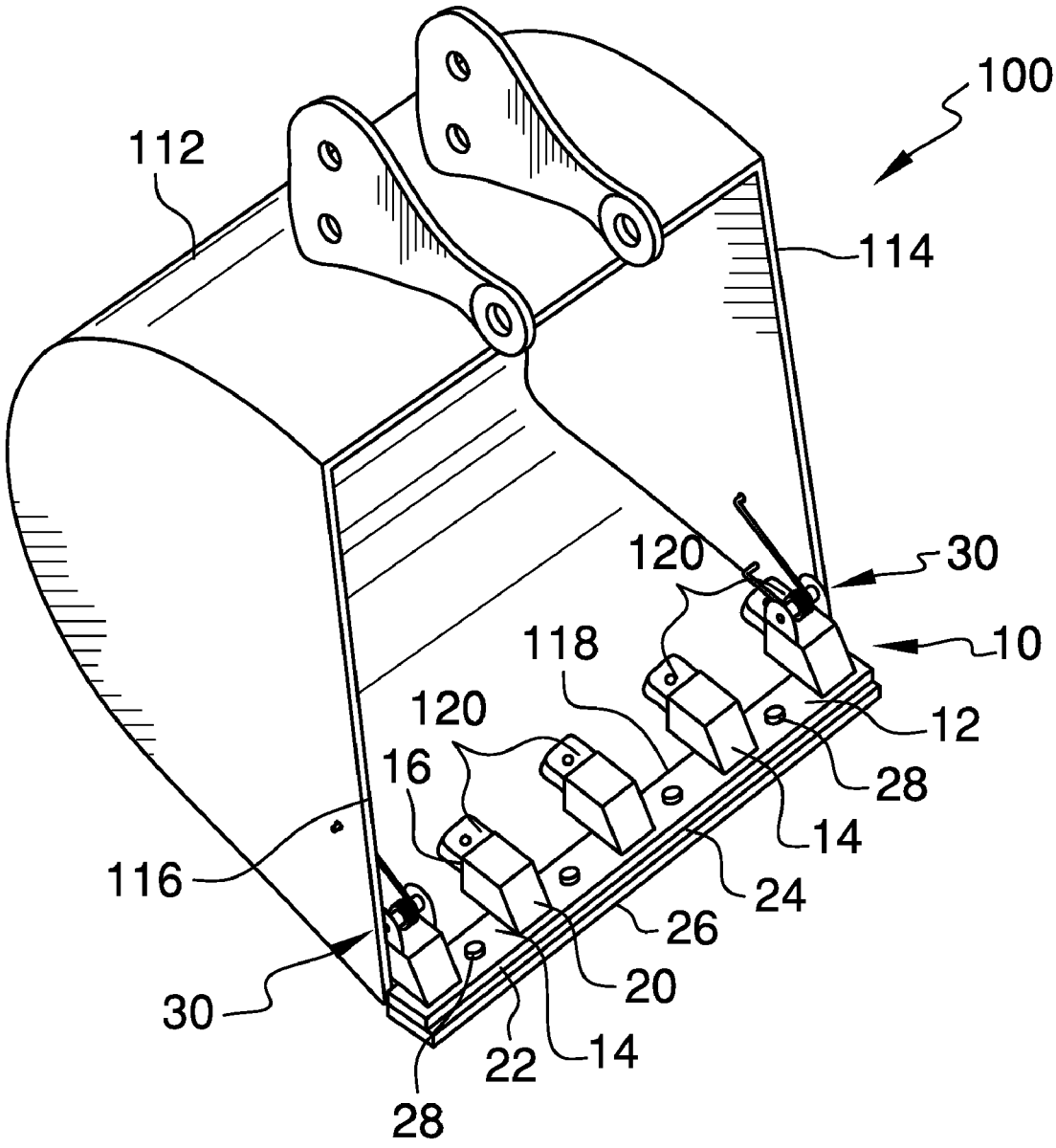
FIG. 2 is a front perspective diagrammatic view of the scraper blade attachment securely mounted to the bucket.

With reference to FIG. 2, the attachment 10 is shown attached to the bucket 100 the teeth 120 snuggly received by the receivers 14 and secured to the bucket by one or more securment means 30 which secures the attachment from moving forwardly and away from the bucket and releasing the teeth from the receivers. An securment means 30 may be positioned approximate each end of the plate 12, and may be attached to a top surface of a receiver 14. Generally, the securment means 30 includes one or more latch arms pivotally attached at one end to the attachment 10 and being rotatable between a first position where a second end of the latch arm is releasably engagable with the bucket 100 and a second position where the second end is not in engaged with the bucket.

Figure 3:
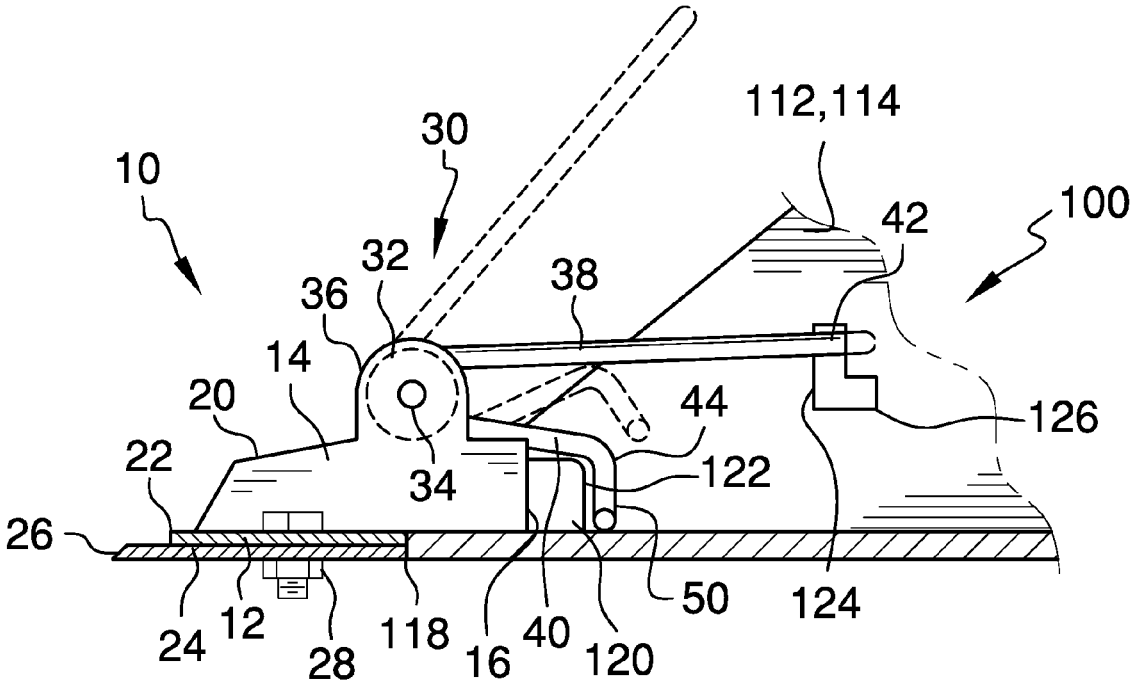
FIG. 3 is diagrammatic partial side elevation view of the scraper blade attachment having a first securment means attached to a toothed bucket.
Figure 4:
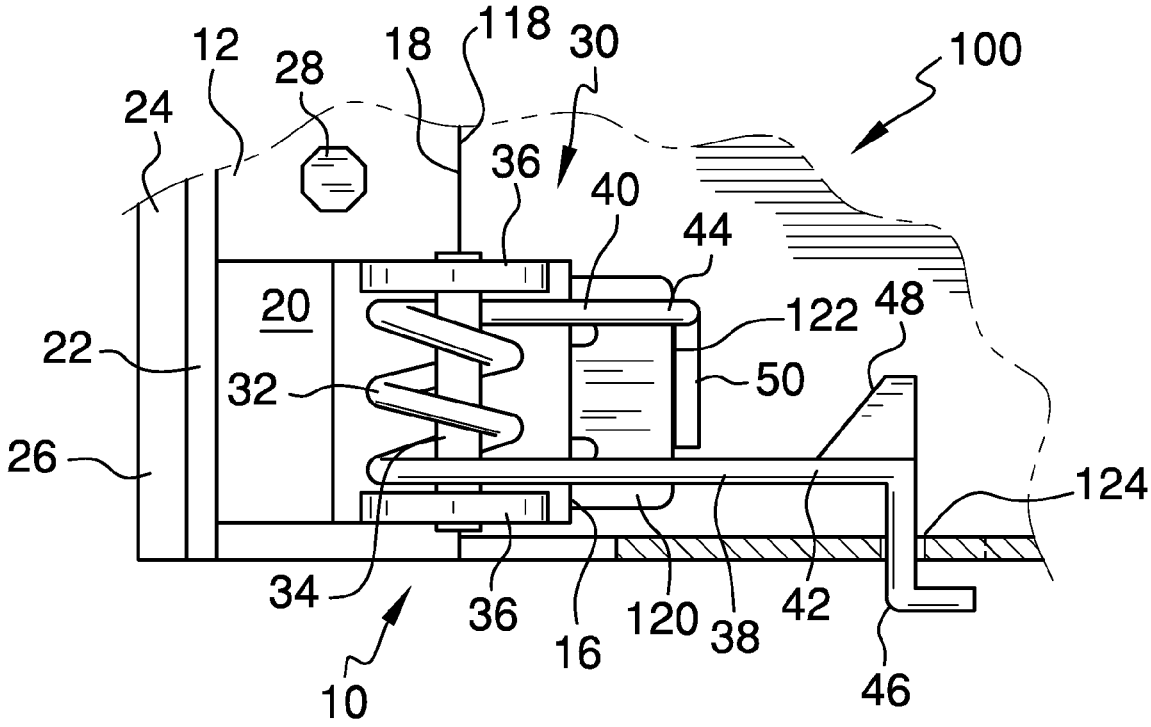
FIG. 4 is a diagrammatic partial top plan view of the scraper blade attachment with the first securment means attached to a toothed bucket.

With reference now to FIGS. 3 and 4, in a first configuration, the securment means 30 is releasably securable and/or engagable with the bucket 100 at a sidewall of the bucket and a tooth 120, such that once secured, the attachment 10 is. The securment means 30 includes a coil spring 32 supported on a shaft 34 that is inserted axially through the center of the coil spring and supported at opposed ends by shaft support members 36. The coil spring 32 may be disposed with the longitudinal axis thereof generally parallel to the longwise direction of the attachment 10. The ends of the coil spring 32 define angularly offset first and second leg portions 38 and 40 that extend outwardly in a direction that is generally normal to the longitudinal axis of the coil spring. The first leg portion 38 provides a first latch arm that is releasably engagable at an end 42 thereof with the bucket 100 in order to secure the scraper blade attachment 10 to the bucket. The second leg portion 40 provides a second latch arm that is also releasably engagable to a rearward facing edge of the bucket 100, such as a rearward edge 122 of a tooth 120 at an end 44 thereof. The first and second end leg portions 38 and 40 are rotatable between a first, non-engaged position where the ends 42 and 44 thereof are free from engagement and no tension is in the coil spring 32, as shown in broken line in FIG. 3, to a second, engaged position where at least the end 42 of the first leg portion 38 is engaged with the bucket 100.

End 42 of the first leg portion/latch arm 38 may be releasably engaged with the bucket 100 by a catch arrangement where the end 42 may be generally L-shaped forming a dog 46, as best shown in FIG. 4. The end 42 is secured to the bucket by inserting it into a vertical slot 124 that is formed through a sidewall 114 of the bucket 100 by aligning the dog 46 with a horizontal notch portion 126 at a lower end of the slot, after which the end is urged upward in the slot 124 by tension in the coil spring 32 where it cannot be withdrawn. A foot pad 48 may be attached to the first leg portion/latch arm 38 towards the end 42 thereof allowing a user to more easily compress the coil spring 32 to align the dog 46 with the slot 124 during engagement and disengagement. To facilitate the engagement of end 44 of the second leg portion 40 to a rearward facing edge, such at that of the rearward facing edge 122 of a tooth 120, the end 44 also includes a dog 50 that is engagable with the rearward facing edge 122, thereby capturing the tooth in the receiver 14. Once the first and second leg portions 38 and 40 are disposed in the engaged position and tension is applied in the coil spring 32, the attachment 10 is held securely and tightly over the teeth 120.

Figure 5:
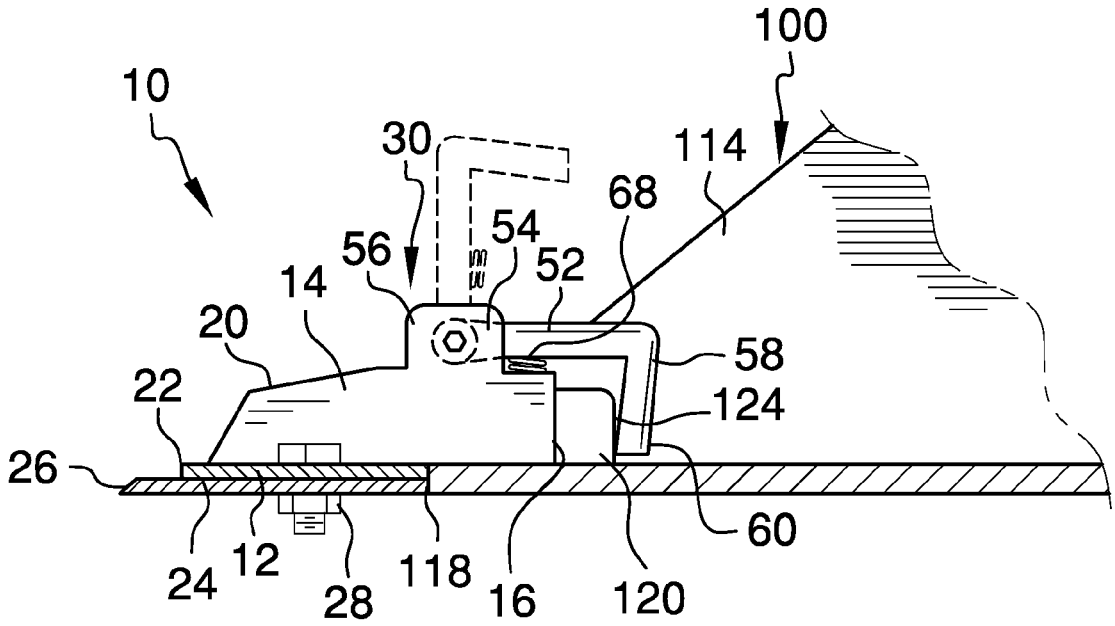
FIG. 5 is a diagrammatic partial side elevation view of the scraper blade attachment having a second securment means attached to a toothed bucket.
Figure 6:
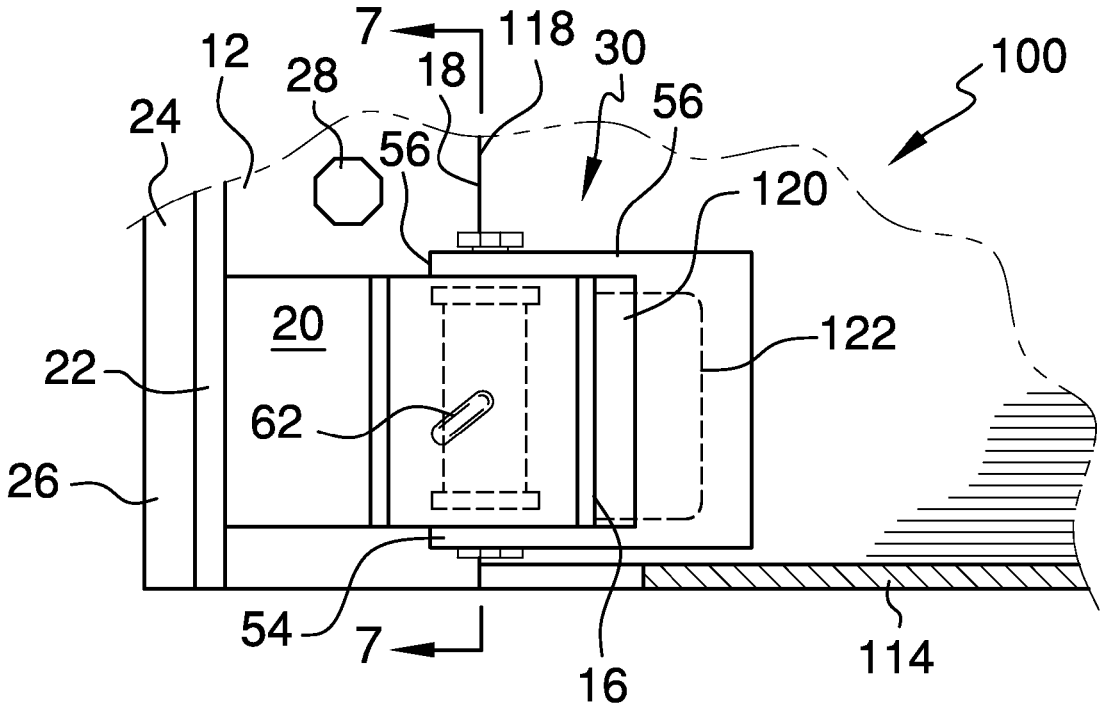
FIG. 6 is a diagrammatic partial top plan view of the scraper blade attachment with the second securment means attached to a toothed bucket.
Figure 7:
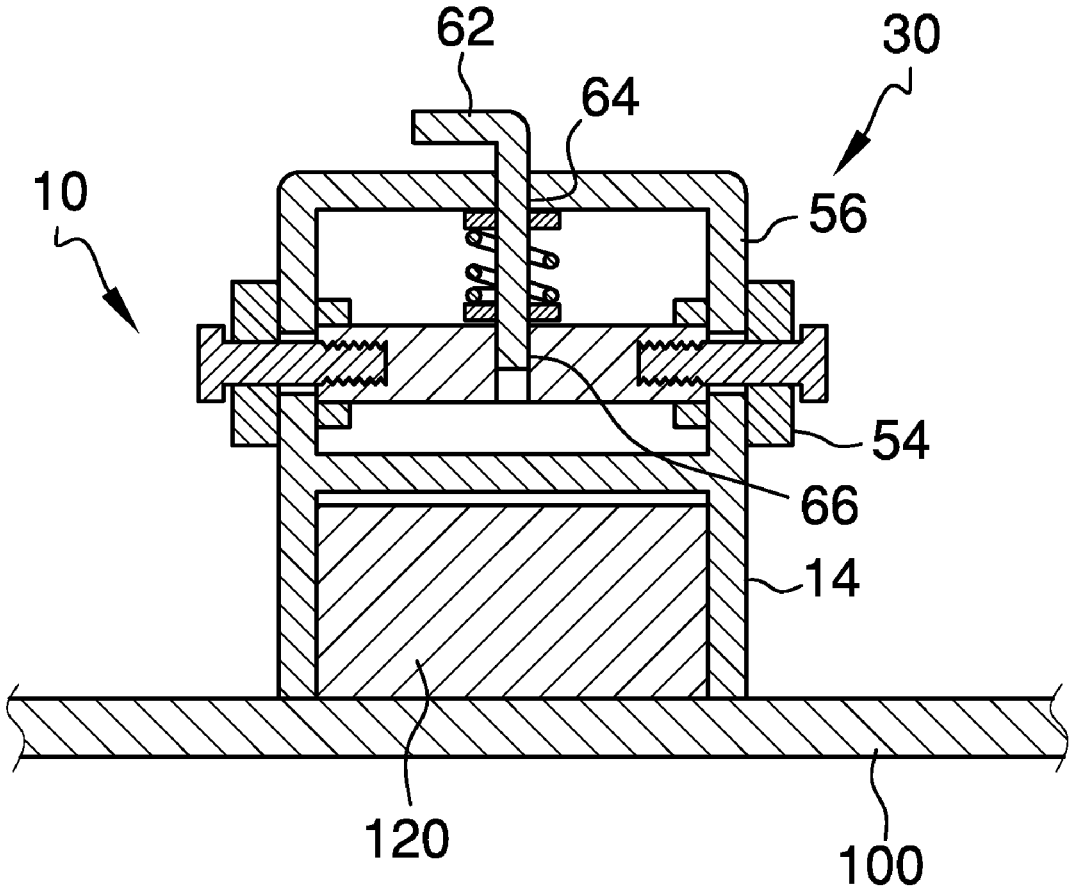
FIG. 7 is a diagrammatic partial cross sectional view taken along line 7-7 in FIG. 5 of the second securment means.

With reference now to FIGS. 5, 6 and 7, in a second configuration, the securment means 30 operates to capture one or more teeth 120 into one more of the receivers 14 to secure the teeth from withdrawal from the respective receiver, and thereby securely retain the attachment 10 to the bucket. In this regard, and in this configuration, a latch arm 52 rotatably connected at one end 54 to a support 56 of the attachment 10 for rotation between a first position, shown in broken line in FIG. 5, where a second end 58 of the latch arm is disposed in an upward non-engaged position and a second position, shown in sold line, where the second end is disposed in a downward engaged position and capturing a tooth 120 into its respective receiver 14. The second end 58 of the latch arm 52 extends perpendicular therefrom and forms a dog 60 which is disposed reward of the tooth 120, thereby capturing the tooth into the receiver 14. The dog 60 may be inwardly bent such that as the latch arm 52 is rotated downward the dog engages a rearward facing surface or edge 122 of the tooth 120 and urges the tooth forwardly into the receiver 14 as the latch arm is further rotated into the engaged position. The latch arm 52 is locked into the engaged position by a pin 62 that is received by cooperating holes 64 and 66 formed through the support 56 and the first end 54 of the latch arm respectively.

A spring element 68 may be attached to the latch arm 52 such that the spring is compressed as the latch arm 52 is rotated into the engaged position to urge the latch arm upward out of the engaged position so that the dog 60 is disposed at an elevation greater than the top surface of the tooth when not locked by the pin 62, thereby permitting removal of the attachment 10 from the bucket 100 without obstruction from the dog 60.

A number of embodiments of the present invention have been described. Nevertheless, it will be understood that various modifications may be made without departing from the spirit and scope of the invention. Accordingly, other embodiments are within the scope of the following claims.

I claim:

1. A blade attachment adapted to be removably mounted to an earth moving bucket of the type having a pair of spaced sidewalls, a cutting edge extending between the sidewalls, and a plurality of teeth laterally spaced along and projecting forwardly of the cutting edge, the attachment comprising in combination:

a plate having an upper surface, a lower surface, a leading edge, a trailing edge and first and second opposed side edges;

a plurality of tooth receiving pockets spaced laterally along said upper surface of said plate and each being configured to receive one or more of the plurality of teeth of the bucket;

an elongated scraper blade extending along said leading edge of said plate;

a securment means for releasably securing said attachment on the bucket with one or more of the plurality of teeth removably seated within said plurality of tooth receiving pockets and said scraper blade position forwardly of the cutting edge of the bucket;

one or more latch arms, wherein each latch arm is rotatably connected to said attachment at a first end and being rotatable between a first position where a second end of said latch arm is engagable with the bucket to secure said attachment to the bucket and a second position where said second end is free from engagement with the bucket; and a coil spring having a first leg extending therefrom providing said latch arm and a second leg extending therefrom, said coil spring being retained by said attachment such that said second leg is engagable with the bucket and said coil spring is tensioned when said latch arm is disposed in said first position, thereby urging said first and said second legs in a direction away from one another.

2. The attachment of claim 1, wherein said second leg is engagable at a rearward facing edge of the bucket.

3. The attachment of claim 2, wherein said rearward facing edge is provided by one or more of the plurality of teeth.

4. A blade attachment adapted to be removably mounted to an earth moving bucket of the type having a pair of spaced sidewalls, a cutting edge extending between the sidewalls, and a plurality of teeth laterally spaced along and projecting forwardly of the cutting edge, the attachment comprising in combination:

a plate having an upper surface, a lower surface, a leading edge, a trailing edge and first and second opposed side edges;

a plurality of tooth receiving pockets spaced laterally along said upper surface of said plate and each being configured to receive one or more of the plurality of teeth of the bucket;

an elongated scraper blade extending along said leading edge of said plate;

a securment means for releasably securing said attachment on the bucket with one or more of the plurality of teeth removably seated within said plurality of tooth receiving pockets and said scraper blade position forwardly of the cutting edge of the bucket, said securment means being positioned on one or more of said plurality of tooth receiving pockets, and being operable to capture one or more of the plurality of teeth within one or more of said plurality of tooth receiving pockets between said one or more tooth receiving pockets;

said securment means includes one or more latch arms, wherein each latch arm is rotatably connected to said attachment at a first end and being rotatable between a first position where a second end of said latch arm is engagable with the bucket to secure said attachment to the bucket and a second position where said second end is free from engagement with the bucket;

said second end of said latch arm includes an end portion that is releasably engagable with a rearward facing edge of the bucket when disposed in said first position; and said rearward facing edge is provided by one or more of the plurality of teeth.

5. The attachment of claim 4, further comprising:

a pin latching said latch arm from rotation when disposed in said first position.

6. The attachment of claim 5, further comprising:

a spring engagable with said latch arm for urging said latch arm into said second position.

7. A blade attachment adapted to be removably mounted to an earth moving bucket of the type having a pair of spaced sidewalls, a cutting edge extending between the sidewalls, and a plurality of teeth laterally spaced along and projecting forwardly of the cutting edge, the attachment comprising in combination:

a plate having an upper surface, a lower surface, a leading edge, a trailing edge and first and second opposed side edges;

a plurality of tooth receiving pockets spaced laterally along said upper surface of said plate and each being configured to receive one or more of the plurality of teeth of the bucket;

an elongated scraper blade extending along said leading edge of said plate;

a securment means for releasably securing said attachment on the bucket with one or more of the plurality of teeth removably seated within said plurality of tooth receiving pockets and said scraper blade position forwardly of the cutting edge of the bucket, said securement means being positioned on one or more of said plurality of tooth receiving pockets;

one or more latch arms, wherein each latch arm is rotatably connected to said attachment at a first end and being rotatable between a first position where a second end of said latch arm is engagable with the bucket to secure said attachment to the bucket and a second position where said second end is free from engagement with the bucket, said second end of said latch arm includes an end portion that is releasably engagable with a rearward facing edge of the bucket when disposed in said first position; and said rearward facing edge is provided by one or more of the plurality of teeth.

8. The attachment of claim 7, wherein said second end of said latch arm includes an end portion that is releasably engagable with a slot formed through a sidewall of the bucket.

9. The attachment of claim 7, wherein said securment means further includes:

a coil spring having a first leg extending therefrom providing said latch arm and a second leg extending therefrom, said coil spring being retained by said attachment such that said second leg is engagable with the bucket and said coil spring is tensioned when said latch arm is disposed in said first position, thereby urging said first and said second legs in a direction away from one another.

10. The attachment of claim 9, wherein said second leg is engagable at a rearward facing edge of the bucket.

11. The attachment of claim 10, wherein said rearward facing edge is provided by one or more of the plurality of teeth.

* * * * *